US010559923B2

(12) United States Patent
Miyamura et al.

(10) Patent No.: US 10,559,923 B2
(45) Date of Patent: Feb. 11, 2020

(54) ELECTRICAL CONNECTION DEVICE WITH CONNECTION DETECTING FUNCTION

(71) Applicants: AutoNetworks Technologies, Ltd., Yokkaichi, Mie (JP); Sumitomo Wiring Systems, Ltd., Yokkaichi, Mie (JP); SUMITOMO ELECTRIC INDUSTRIES, LTD., Osaka-shi, Osaka (JP)

(72) Inventors: Tetsuya Miyamura, Mie (JP); Masaaki Tabata, Mie (JP); Yasuo Omori, Mie (JP); Hajime Matsui, Mie (JP); Kazuaki Takeda, Mie (JP); Takuya Inoue, Mie (JP)

(73) Assignees: AutoNetworks Technologies, Ltd. (JP); Sumitomo Wiring Systems, Ltd. (JP); Sumitomo Electric Industries, Ltd. (JP)

( * ) Notice: Subject to any disclaimer, the term of this patent is extended or adjusted under 35 U.S.C. 154(b) by 30 days.

(21) Appl. No.: 15/750,574

(22) PCT Filed: Jul. 22, 2016

(86) PCT No.: PCT/JP2016/071631
§ 371 (c)(1),
(2) Date: Feb. 6, 2018

(87) PCT Pub. No.: WO2017/026252
PCT Pub. Date: Feb. 16, 2017

(65) Prior Publication Data

US 2019/0013622 A1 Jan. 10, 2019

(30) Foreign Application Priority Data

Aug. 7, 2015 (JP) ..... 2015-156829

(51) Int. Cl.
*H01R 13/627* (2006.01)
*H01R 13/641* (2006.01)

(52) U.S. Cl.
CPC ..... *H01R 13/641* (2013.01); *H01R 13/6272* (2013.01)

(58) Field of Classification Search
CPC .....
H01R 13/641; H01R 13/6272; H01R 13/436; H01R 43/26; H01R 13/64
(Continued)

(56) References Cited

U.S. PATENT DOCUMENTS 5,203,718 A 4/1993 Chishima
5,217,390 A 6/1993 Nozaki et al.
(Continued)

FOREIGN PATENT DOCUMENTS

JP 04-147583 5/1992
JP 2014-044825 3/2014
JP 2015-041469 3/2015

OTHER PUBLICATIONS

International Search Report dated Sep. 20, 2016.

*Primary Examiner* — Hae Moon Hyeon
(74) *Attorney, Agent, or Firm* — Gerald E. Hespos; Michael J. Porco; Matthew T. Hespos

(57) ABSTRACT

An electrical connection device includes a first connector (C1) having a first housing (10), a second connector (C2) having a second housing (20) for receiving the insertion of the first housing (10), and a connection detecting tool (30). The first housing (10) includes a housing body (12), a lock (14) having a tool restraining portion (14*d*) and a displacement restricting portion (16) for blocking an insertion allowing displacement of the lock (14). The connection detecting tool (30) is held at an operating position to resiliently deform the displacement restricting portion (16) to allow the insertion allowing displacement. The tool restraining portion
(Continued)

(14*d*) restrains the connection detecting tool (30) at the operating position so as not to be separable while allowing the separation of the connection detecting tool (30) from the operating position as the lock (14) resiliently returns to a lock position.

5 Claims, 6 Drawing Sheets

(58) Field of Classification Search
USPC ..... 439/357
See application file for complete search history.

(56) References Cited

U.S. PATENT DOCUMENTS

| | | | | |
|---|---|---|---|---|
| 5,330,369 | A | 7/1994 | Nozaki et al. | |
| 5,429,527 | A | 7/1995 | Nozaki et al. | |
| 2017/0294722 | A1* | 10/2017 | Matsui | H01R 13/514 |
| 2018/0131117 | A1* | 5/2018 | Washio | H01R 13/42 |

* cited by examiner

ELECTRICAL CONNECTION DEVICE WITH CONNECTION DETECTING FUNCTION

BACKGROUND

Field of the Invention

The invention relates to an electrical connection device including a first connector and a second connector connectable to each other and having a function of detecting a connected state of the first and second connectors.

Description of the Related Art

Japanese Unexamined Patent Publication No. 2014-44825 and Japanese Unexamined Patent Publication No. 2015-41469 disclose electrical connection devices having a connection detecting function. Devices disclosed in these references include first and second connectors connectable to each other and a tool for detecting the connection of these connectors. The first connector ("female connector" mentioned in the both references) is shaped to receive the second connector ("male connector" mentioned in the both references). The first connector includes a lock piece deflectable and deformable inward as the second connector is inserted. The tool is inserted into the first connector together with the second connector, and specifically between a body of the second connector and the lock piece.

In these devices, the lock piece is deflected and deformed while the connection of the connectors proceeds, thereby blocking the tool from being separated from the lock piece. On the other hand, the lock piece resiliently returns toward an initial position after the connection of the connectors is completed properly, thereby allowing the tool to be separated from the lock piece. Thus, an operator can recognize that the connectors are connected incompletely if the tool cannot be separated.

However, in the devices described in Japanese Unexamined Patent Publication No. 2014-44825 and Japanese Unexamined Patent Publication No. 2015-41469, there is a possibility that the connectors are connected without the tool being mounted, for example, because the use of the tool for connection detection is forgotten. That is, the connectors may be used without the connected state being confirmed by the tool.

The invention aims to provide an electrical connection device including a first connector and a second connector connectable to each other and configured to more reliably detect a connected state of the first and second connectors.

SUMMARY

An electrical connection device in accordance with the invention has a first connector including a first terminal and a first housing for holding the first terminal, a second connector including a second terminal to be electrically conductive to the first terminal by being connected to the first terminal and a second housing for holding the second terminal, and a connection detecting tool for detecting a connected state between the first and second terminals. The second housing is shaped to receive the insertion of the first housing therein, and the first and second terminals are connected to each other according to the insertion of the first housing. The first housing includes a housing body for holding the first terminal. A lock is connected to the housing body is capable of undergoing an insertion allowing displacement to resiliently displace toward the housing body to allow the insertion of the first housing from an insertion blocking position where the insertion of the first housing into the second housing is blocked by the interference of the lock with the second housing. The lock is configured to lock the first housing in the second housing by resiliently returning in a direction opposite to a direction of the insertion allowing displacement to be locked to the second housing with the first housing inserted in the second housing to a proper connection position where the connection of the first and second terminals is completed. A displacement restricting portion is connected to the housing body or the lock and is configured to block the insertion allowing displacement of the lock from the insertion blocking position by being interposed between the housing body and the lock. The housing body includes a tool holding portion for holding the connection detecting tool at an operating position. The connection detecting tool operates the displacement restricting portion at the operating position such that the displacement restricting portion is resiliently deformable to allow the insertion allowing displacement of the lock portion. The lock portion includes a tool restraining portion. The tool restraining portion restrains the connection detecting tool to block the departure of the connection detecting tool at the operating position from the operating position in a state where the lock is undergoing the insertion allowing displacement. However, the tool restraining portion releases the connection detecting tool to allow the removal of the connection detecting tool from the operating position as the lock resiliently returns to a lock position.

According to this electrical connection device, the insertion of the first housing into the second housing can proceed while being accompanied by the insertion allowing displacement of the lock in a state where the connection detecting tool is held at the operating position by the tool holding portion of the housing body of the first housing and the displacement restricting portion of the first housing is resiliently deformed to allow the insertion allowing displacement of the lock, and the connection of the first and second connectors and the connected state thereof can be detected by inserting the first housing.

Specifically, in an incompletely connected state before the first housing reaches the proper connection position, i.e. a position where the connection of the first and second terminals is completed, the lock of the first housing undergoes the insertion allowing displacement, i.e. a displacement toward the housing body and the tool restraining portion of the lock portion restrains the connection detecting tool. Thus, the connection detecting tool cannot depart from the operating position. Accordingly, when the connection detecting tool cannot be separated, an operator can recognize the incompletely connected state where the first and second terminals are insufficiently connected. On the other hand, when the first housing reaches the proper connection position by the above insertion, the tool restraining portion of the lock portion releases the connection detecting tool and allows the departure of the connection detecting tool from the operating position as the lock resiliently returns to the lock position. Thus, when the separation of the connection detecting tool is possible as just described, the operator can recognize that the connection of the first and second terminals has been completed.

In addition, as long as the connection detecting tool is not held at the operating position by the tool holding portion of the first housing, i.e. as long as the connection detecting tool is not mounted in the first housing in advance, the displacement restricting portion of the first housing is at the displacement blocking position to block the insertion allowing displacement of the lock portion. Thus, the first housing cannot be inserted into the second housing due to the interference of the lock portion and the second housing. This reliably prevents the connecting operation of the first and second connector from proceeding without using the connection detecting tool In the present invention the tool holding portion may allow the connection detecting tool to be inserted in a tool inserting direction parallel to an inserting direction of the first housing into the second housing along an outer side surface of the housing body. The displacement restricting portion may be shaped to extend from the lock toward the housing body at the displacement blocking position. The displacement restricting portion may include an engaging end portion engageable with the housing body and restrict the insertion allowing displacement with the engaging end portion engaged with the housing body, and the connection detecting tool may operate the engaging end portion in the tool inserting direction and disengage the engaging end portion and the housing body by being inserted to the operating position into the tool holding portion along the tool inserting direction. Thus, the displacement restricting portion is set in a state resiliently deformable to allow the insertion allowing displacement of the lock portion. In this mode, the first housing can be made insertable into the second housing merely by a simple operation of inserting the connection detecting tool into the tool holding portion along the outer surface of the housing body.

In this case, the displacement restricting portion may be shaped to be resiliently bendable and deformable in the tool inserting direction to enable the engaging end portion to be deflected and deformed in the tool inserting direction.

The connection detecting tool may include a restrained portion projecting more toward the lock than other parts on a front end in the tool inserting direction, and the tool restraining portion of the lock portion restrains the restrained portion to block a rearward movement of the restrained portion in the tool inserting direction by projecting toward the housing body. A combination of the restrained portion and the tool restraining portion enables the departure of the connection detecting tool from the operating position toward a rear side in the tool inserting direction to be more reliably blocked.

DETAILED DESCRIPTION

A preferred embodiment of the invention is described with reference to the drawings.

An electrical connection device according to this embodiment includes a first connector C1, a second connector C2 and a connection detecting tool 30. The first connector C1 includes female terminals T1 and a first housing 10 for holding the female terminals T1. The second connector C2 includes male terminals T2 and a second housing 20 for holding the male terminals T2. The female terminals T1 and the male terminals T2 are respectively connectable to each other and can be electrically conductive to each other by being connected. The connection detecting tool 30 is mounted into the first housing 10 to detect a connected state between the female terminals T1 and the male terminals T2.

Figure 4:
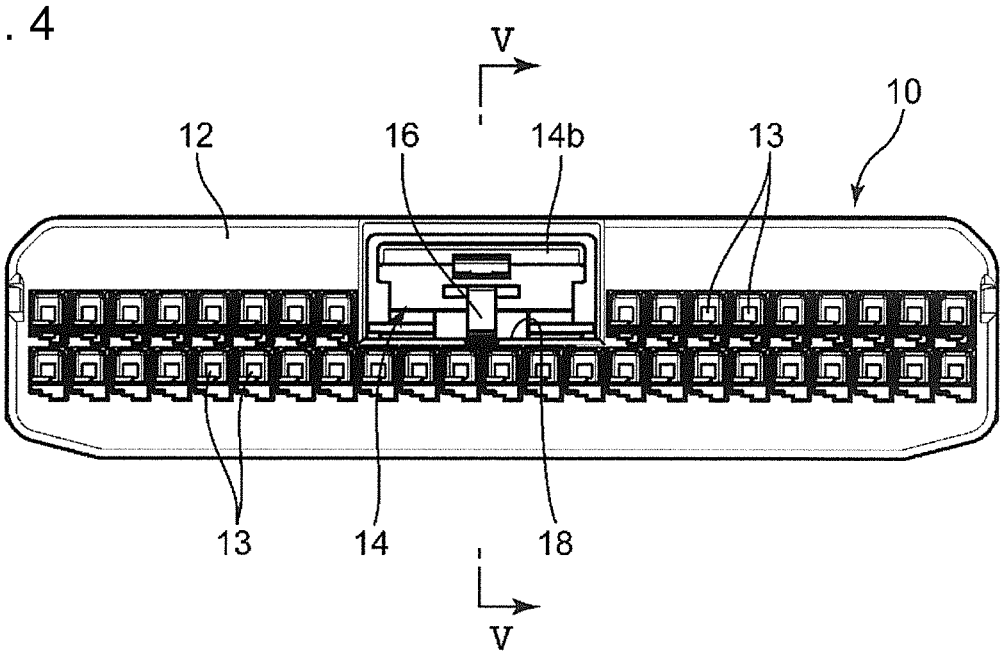
FIG. 4 is a front view of the first housing.
Figure 5:
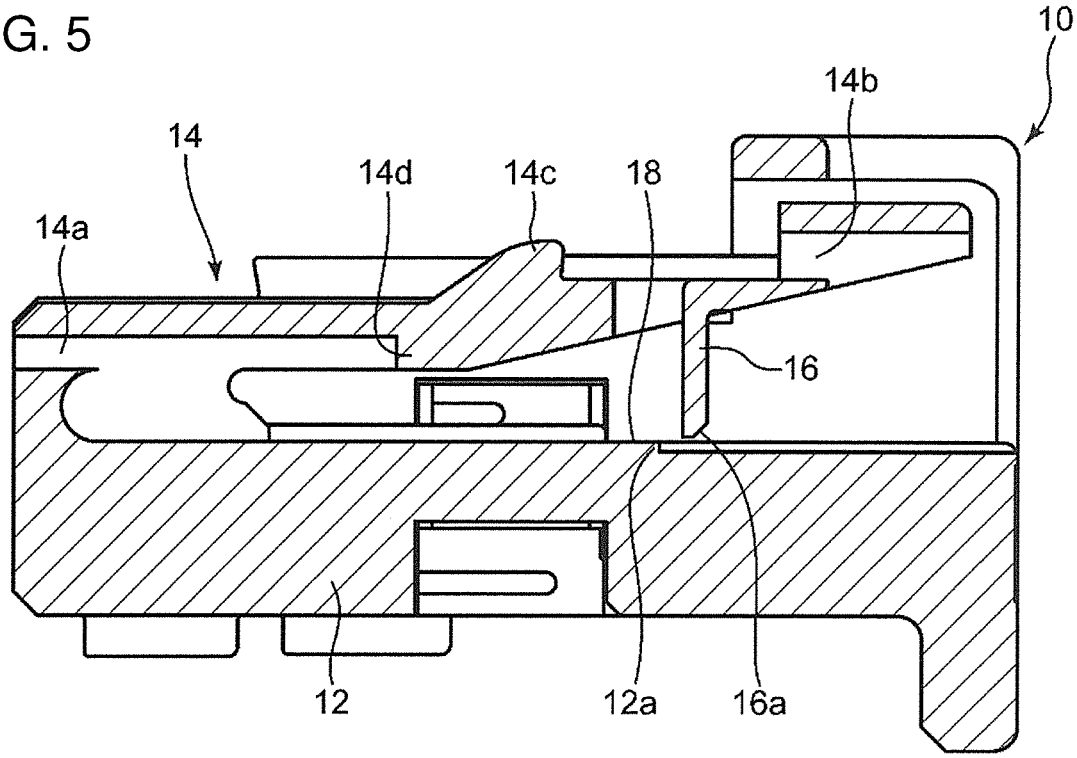
FIG. 5 is a section along V-V of FIG. 4.

As shown in FIGS. 4 and 5, the first housing 10 includes a housing body 12 for holding the female terminals T1, a lock 14 and a displacement restricting portion 16 connected to this lock 14.

The housing body 12 is shaped to be insertable into the second housing 20, i.e. has a substantially rectangular parallelepiped shape in this embodiment. The housing body 12 includes terminal accommodation chambers 13 for receiving each of the female terminals T1 and terminal locking portions for respectively locking the female terminals T1 received into the respective terminal accommodation chambers 13, e.g. locking lances.

The lock 14 is connected to this housing body and has the following functions:

a) The lock 14 is located at an insertion blocking position to interfere with the second housing 20 in an undeformed state (FIG. 1) and blocks the insertion of the first housing 10 into the second housing 20 by this interference in a state fixed at this insertion blocking position;

b) The lock 14 can be displaced resiliently, i.e. undergo an insertion allowing displacement, from the insertion blocking position toward the housing body 12 to allow the insertion of the first housing 10 while being resiliently deformed; and c) The lock 14 can resiliently return to a lock position in a direction opposite to a direction of the insertion allowing displacement with the first housing 10 inserted in the second housing 20 (FIG. 3) until reaching a proper connection position where the connection of the female terminals T1 and the male terminals T2 is completed. At this lock position, the lock 14 is locked to the second housing 20 to lock the first housing 10 in the second housing 20.

To exhibit the above functions, the lock 14 according to this embodiment is cantilevered roughly rearward from the upper surface of a front part of the housing body 12. Specifically, the lock 14 includes a front end 14*a* integrally connected to the upper surface of the front end part of the housing body 12, a rear end 14*b* that is opposite to the front end 14*a* and is resiliently deflectable and deformable in a direction toward the housing body 12 (down in FIGS. 1 to 3) due to resilient deformation of the lock 14 with the front end portion 14*a* as a support, and a locked portion 14*c* projecting up between the front end portion 14*a* and the rear end portion 14*b*. The insertion blocking position is a position where the locked portion 14*c* interferes with the second housing 20 to block insertion of the first housing 10 into the second housing 20, as shown in FIG. 1.

Figure 1:
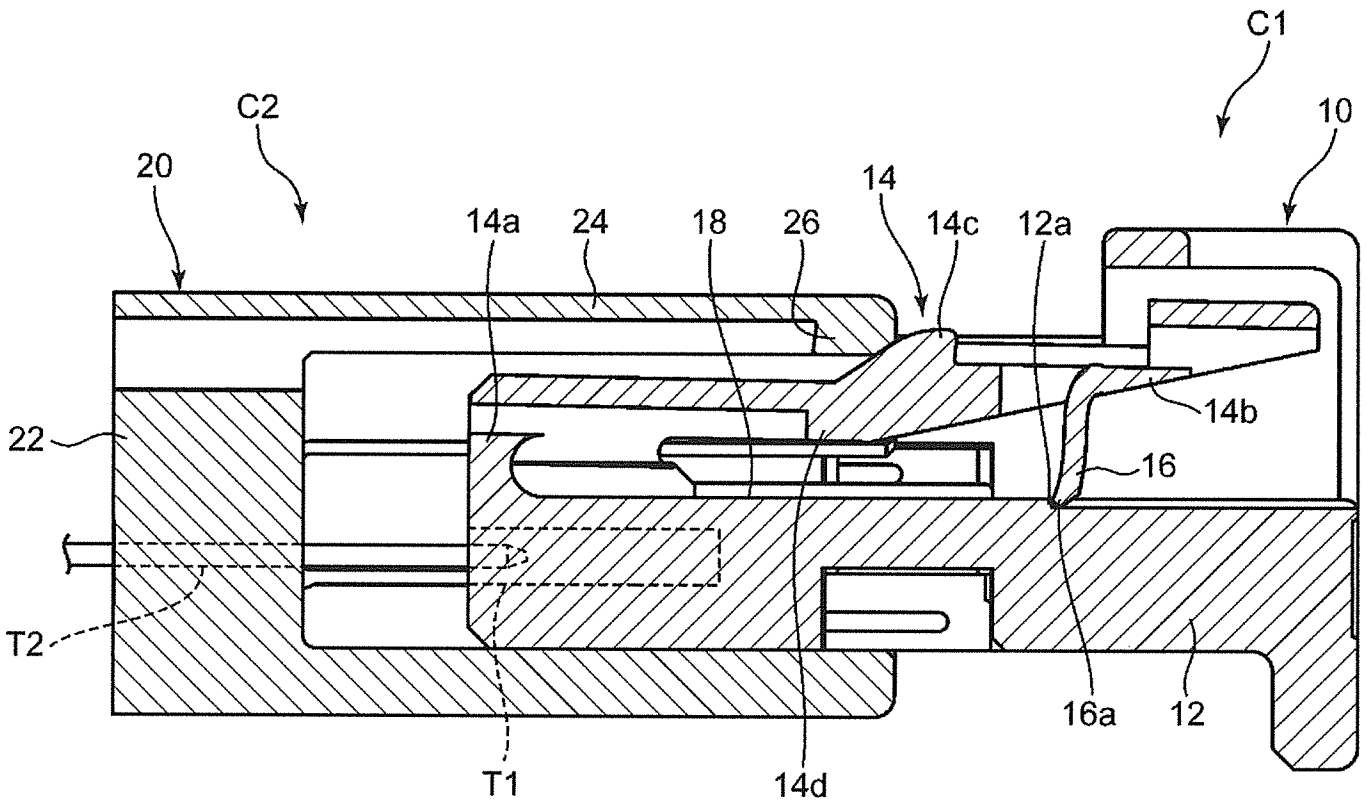
FIG. 1 is a side view in section showing a state where a displacement restricting portion of a first housing blocks an insertion allowing displacement of a lock of the first housing to block the insertion of the first housing into a second housing in an electrical connection device according to an embodiment of the present invention.
Figure 2:
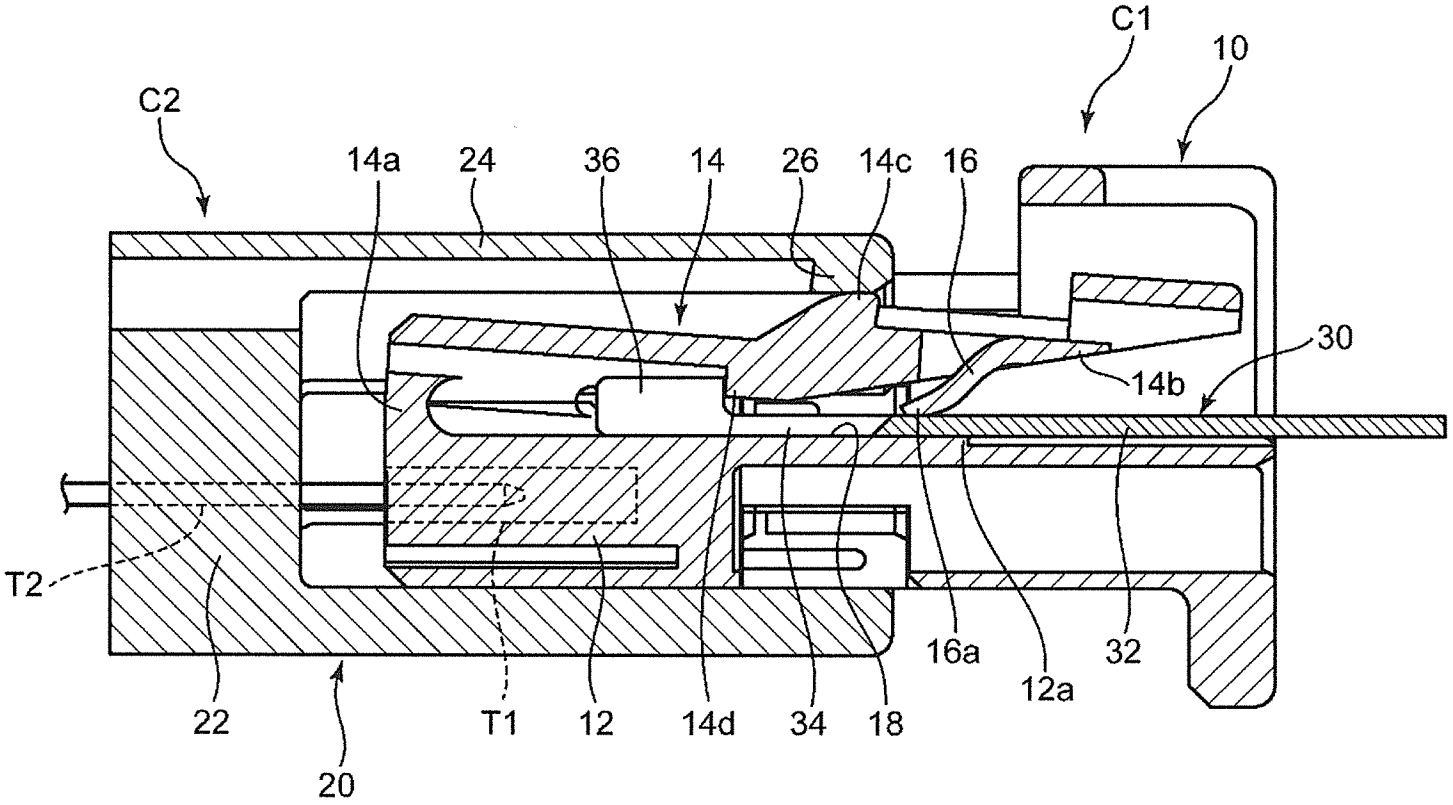
FIG. 2 is a side view in section showing an incompletely connected state before the first housing is inserted into the second housing while being accompanied by the insertion allowing displacement of the lock and reaches a proper connection position with a connection detecting tool inserted in the first housing in the electrical connection device.
Figure 3:
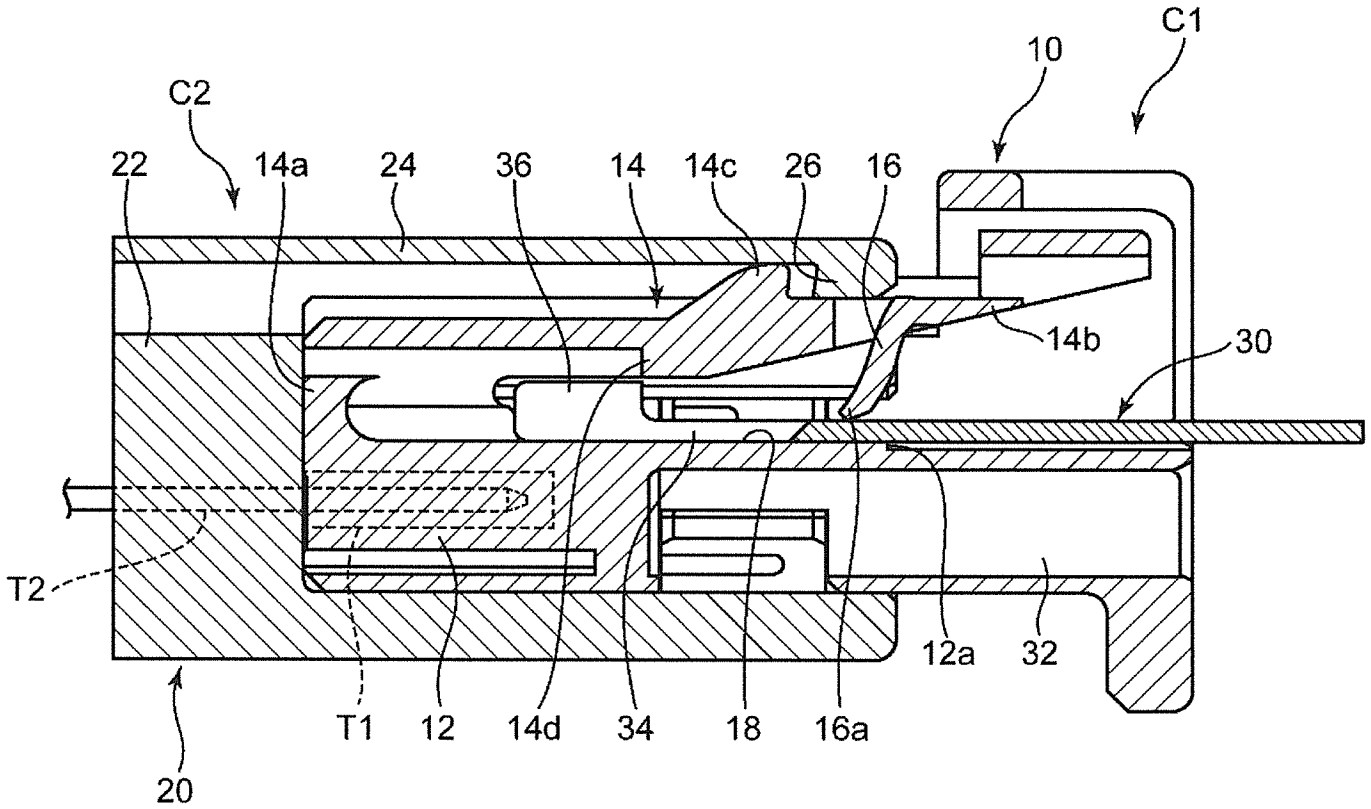
FIG. 3 is a side view in section showing a state where the first housing is at the proper connection position in the electrical connection device.

The displacement restricting portion 16 is at a displacement blocking position shown in FIGS. 1, 4 and 5 in an undeformed state and is resiliently deformable, as shown in FIGS. 2 and 3. The displacement restricting portion 16 blocks the insertion allowing displacement of the lock 14, as shown in FIG. 2 by being interposed between the housing body 12 and the lock 14 at a displacement blocking position while allowing a resilient displacement of the lock 14 at the displacement allowing position.

Specifically, the displacement restricting portion 16 according to this embodiment is shaped to extend from the lock 14 toward an outer side surface (upper side surface in FIGS. 1 to 5) of the housing body 12 (extend down in FIGS. 1 to 3) in a direction substantially perpendicular to the outer side surface at the displacement blocking position. An end part (lower end part in FIGS. 1 to 3) of this displacement restricting portion 16 constitutes an engaging end portion 16*a*. This engaging end portion 16*a* engages the outer side surface of the housing body 12; in this embodiment, butts against a small step 12*a* formed on the upper side surface of the housing body 12, when the lock 14 is displaced toward the housing body 12 by a small amount, thereby enabling the displacement restricting portion 16 to block any further resilient displacement of the lock 14 toward the housing body 12, i.e. the insertion allowing displacement. Further, the displacement restricting portion 16 is resiliently bendable so that the engaging end portion 16*a* is deflected and displaced forward in an inserting direction of the first housing into the second housing 20, specifically in the form of a tongue having a thickness substantially parallel to a front-rear direction.

Figure 6:
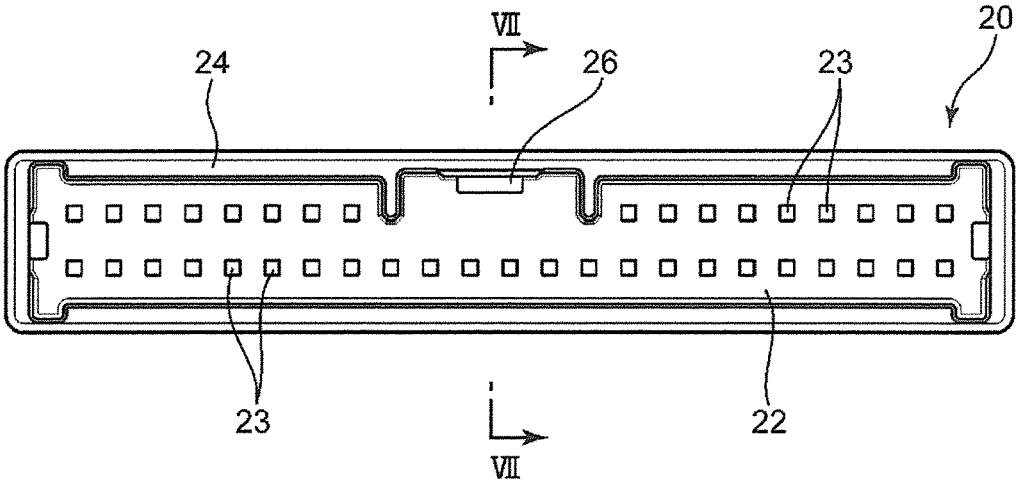
FIG. 6 is a front view of the second housing.
Figure 7:
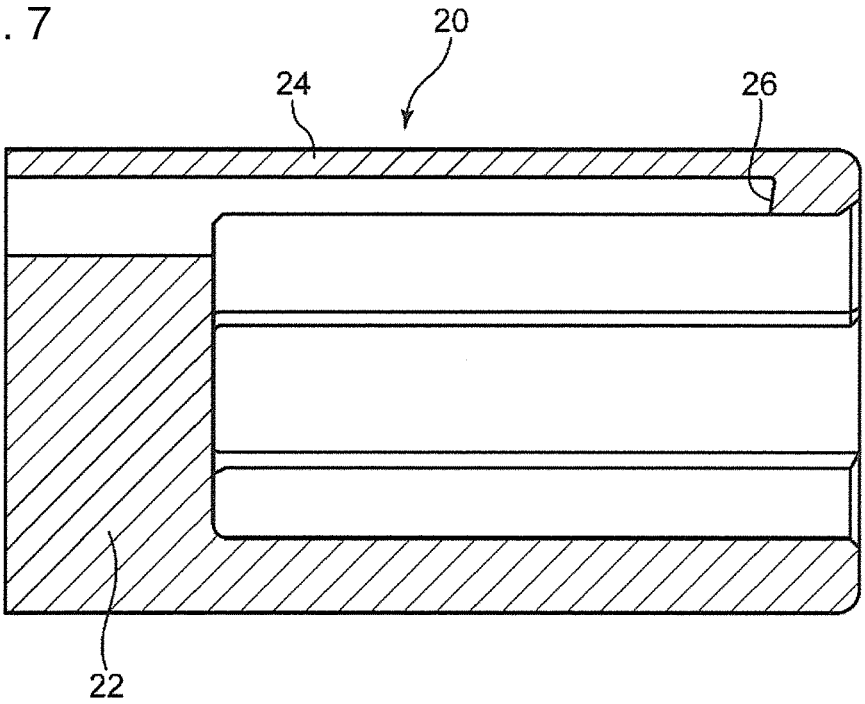
FIG. 7 is a section along VII-VII of FIG. 6.
Figure 8:
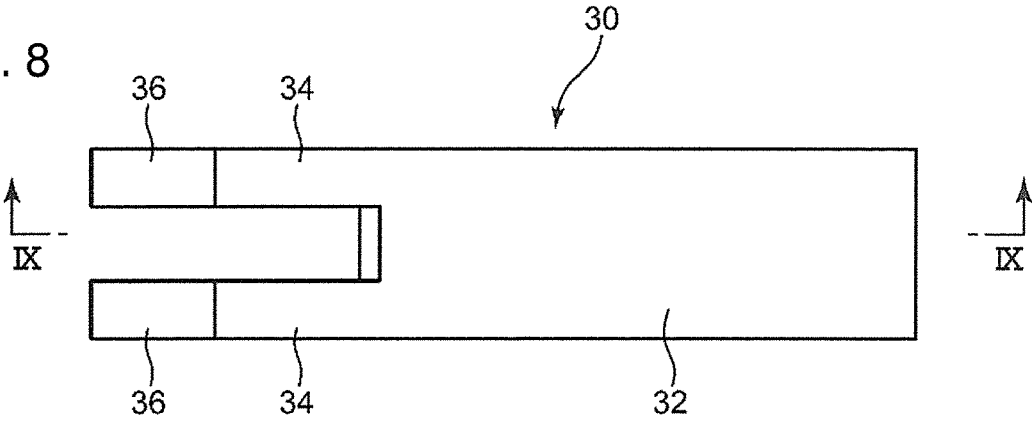
FIG. 8 is a bottom view of the connection detecting tool.
Figure 9:
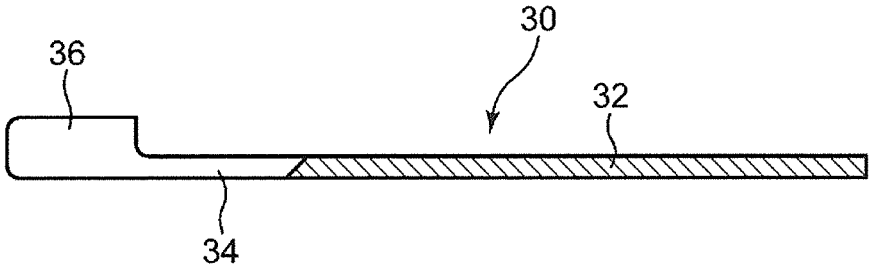
FIG. 9 is a section along IX-IX of FIG. 8.

The second housing 20 is shaped to enclose a receiving space. The receiving space is a space for receiving the housing body 12 of the first housing 10. Specifically, the second housing 20 integrally includes a back wall 22 and a peripheral wall 24. The back wall 22 is facing the housing body 12 of the first housing 10 inserted into the receiving space in a direction (lateral direction in FIGS. 1 to 3) parallel to an inserting direction of the housing body 12. The peripheral wall 24 is in the form of a rectangular tube enclosing the receiving space and one end part thereof is connected integrally to the back wall 22. As shown in FIGS. 6 and 7, the back wall 22 includes terminal press-fit holes 23, and the male terminals T2 are press-fit respectively into the plurality press-fit holes 23. Thus, the back wall 22 holds the male terminals T2 press-fit into the respective terminal press-fit holes 23.

The peripheral wall 24 includes an opening end part enclosing an insertion inlet for the first housing 10. This opening end part is an end part opposite to the back wall 22. A part of this opening end part constitutes a lock piece operating portion 26 projecting more inward than other parts. This lock piece operating portion 26 is a part for operating the locked portion 14*c* of the lock 14 and the lock piece operating portion 26 and the locked portion 14*c* cooperate with each other to exhibit the following functions:

a) The lock piece operating portion 26 comes into contact with the locked portion 14*c* of the lock 14 as the first housing 10 is inserted into the receiving space of the second housing 10. The lock piece operating portion 26 blocks the insertion of the first housing into the second housing 20 by contact, i.e. interference with the locked portion 14*c* when the displacement restricting portion 16 is at a displacement restricting position shown in FIGS. 4 and 5 to restrict the insertion allowing displacement of the lock 14. On the other hand, the locked portion 14*c* is pressed by the lock piece operating portion 26 and undergoes the insertion allowing displacement toward the housing body 12 (FIG. 2) as the first housing 10 is inserted into the second housing 20, when the displacement restricting portion 16 is deformed resiliently to allow the insertion allowing displacement. Thus, the locked portion 14*c* slips inside (under in FIG. 2) the lock piece operating portion 26 to allow the insertion of the first housing into the second housing 20.

b) The lock piece operating portion 26 stops pressing the locked portion 14*c*, and the lock 14, including the locked portion 14*c*, resiliently returns to the lock position shown in FIG. 3 when the first housing 10 reaches the proper connection position where the female terminals T1 and the male terminals T2 are connected completely. The lock piece operating portion 26 is located behind (right side in FIG. 3) the locked portion 14*c* of the lock 14 that has returned resiliently in the inserting direction, thereby restraining the locked portion 14*c* from behind to block a rearward movement of the first housing 10, i.e. lock the first housing 10 in the second housing 20.

The lock position shown in FIG. 3 may be a position where the lock 14 resiliently returns 100% to the insertion blocking position shown in FIG. 1 or may be a position where the lock 14 resiliently returns at a rate below 100%, i.e. a position slightly closer to the housing body 12 than at the insertion blocking position.

The connection detecting tool 30 enables the insertion allowing displacement of the lock 14 and enables the first housing 10 to be inserted into the second housing 20 by being mounted into the first housing 10 of the first connector C1 in advance before the connection of the first connector C1 and the second connector C2. Further, the connection detecting tool 30 is held in the first housing 10 to be separable from the first housing 10 only in a state where the connection of the first connector C1 and the second connector C2 is completed, i.e. in a state where the first housing 10 is at the proper connection position, thereby enabling the detection of the connected state of the first and second connectors C1, C2.

Specifically, the housing body 12 of the first housing 10 includes a tool holding portion or groove 18 for detachably holding the connection detecting tool 30 at a predetermined operating position. In this embodiment, a groove 18 is formed in the housing body 12. This groove 18 is a recess in an area of the upper surface of the housing body 12 covered with the lock 14 and extends straight in a tool inserting direction parallel to the inserting direction while having a constant width.

The connection detecting tool 30 integrally includes a tool body 32 and left and right branches 34 and is shaped to be entirely insertable forward into the groove 18 from behind along the tool inserting direction (i.e. along the outer side surface of the housing body 12).

The tool body 32 is shaped to extend along the tool inserting direction while having a constant width substantially equal to that of the groove 18. This tool body 32 disengages the engaging end portion 16*a* and the step 12*a* by contacting the engaging end portion 16*a* of the displacement restricting portion 16 connected to the lock 14 and operates the engaging end portion 16*a* to displace the engaging end portion 16*a* in the tool inserting direction as being inserted to a specific operating position (position shown in FIG. 2) into the groove 18 along the tool inserting direction. In this way, the displacement restricting portion 16 enters a state capable of being resiliently deformed to allow the insertion allowing displacement of the lock 14 (bending deformation to increase a forward displacement amount of the engaging end portion 16*a* according to the insertion allowing displacement). Specifically, at the operating position, the connection detecting tool 30 resiliently bends and deforms the displacement restricting portion 16 to incline the displacement restricting portion 16 in such a direction that the engaging end portion 16*a* of the displacement restricting portion 16 is located before other parts in the tool inserting direction.

The branches 34 are branched from the front end of the tool body 32 and further extend forward. A restrained portion 36 is formed on the front end of each branch 34. Each restrained portion 36 projects in a direction (up in FIGS. 1 to 3) to approach the lock 14 more than the other parts. A suitable interval is given in a width direction between the restrained portions 36. This interval is an interval for preventing the interference of each restrained portion 36 and the displacement restricting portion 16 associated with the insertion of the connection detecting tool 30 along the tool inserting direction, i.e. an interval for allowing the passage of the displacement restricting portion 16 between the restrained portions 36.

The lock 14 includes a tool restraining portion 14*d*. This tool restraining portion 14*d* restrains the connection detecting tool 30 by locking the restrained portions 36 of the connection detecting tool 30 at the operating position in a state where the lock 14 undergoes the insertion allowing displacement (i.e. in a state where the lock 14 is displaced resiliently toward the housing body 12 to allow the insertion of the first housing 10 into the second housing 20). Specifically, the tool restraining portion 14*d* projects in a direction (down in FIGS. 1 to 3) to approach the housing body 12 more than the other parts at a suitable position of an inner side surface (lower surface in FIGS. 1 to 3) of the lock 14, and blocks the departure of the connection detecting tool 30 from the operating position in a direction opposite to the tool inserting direction by being located behind the restrained portions 36 to block a retreat along the tool inserting direction, as shown in FIG. 2.

According to this electrical connection device, the connection of the first and second connectors C1, C2 and, further, the connected state thereof can be confirmed, for example, in the following manner.

1) Mounting of the Connection Detecting Tool 30 into the First Housing 10:

Prior to the connection of the connectors C1, C2, the connection detecting tool 30 is mounted at the predetermined operating position of the first housing 10 of the first connector C1. Specifically, the connection detecting tool 30 is inserted at the inner side of the lock 14 along the groove 18 of the housing body 12 of the first connector 10 in the tool inserting direction along the outer side surface of the housing body 12 with the branches 34 thereof in the lead. According to this insertion, the tool body 32 of the connection detecting tool 30 operates the engaging end portion 16*a* of the displacement restricting portion 16 in the tool inserting direction to deflect and displace the engaging end portion 16*a* to be separated from the step 12*a* of the housing body 12 in the tool inserting direction. Thus, the displacement restricting portion 16 is made resiliently deformable to allow the insertion allowing displacement of the lock 14. Specifically, the displacement restricting portion 16 can be resiliently bent and deformed to increase the forward displacement amount of the engaging end portion 16*a* of the displacement restricting portion 16 according to the insertion allowing displacement.

It is not possible to insert the first housing 10 into the second housing 20 as shown in FIG. 1 in a state where the connection detecting tool 30 is not mounted, i.e. in a state where the connection detecting tool 30 is not operating the displacement restricting portion 16. In this state, the engaging end portion 16*a* of the displacement restricting portion 16 butts against the step 12*a* of the housing body 12, thereby blocking a displacement of the lock 14 toward the housing body 12 (insertion allowing displacement). In this way, the interference of the locked portion 14*c* of the lock 14 and the lock piece operating portion 26 of the second housing 20 is continued and this interference disables the insertion of the first housing 10 into the second housing 20.

Specifically, the displacement restricting portion 16 is kept at the displacement blocking position to block the insertion allowing displacement of the lock 14 toward the housing body 12 unless being operated by the connection detecting tool 30, thereby blocking the insertion of the first housing 10 into the second housing 20. This can reliably prevent the connection of the first and second connectors C1, C2 without the connection detecting tool 30 being used, i.e. prevent the use of the connection detecting tool 30 from being forgotten.

2) Connection of the Connectors C1 and C2

The first housing 10 is inserted into the second housing 20 with the connection detecting tool 30 mounted in the first housing 10 to deform the displacement restricting portion 16 as described above. During this insertion, the locked portion 14*c* of the lock 14 butts against the lock operating portion 26 of the second housing 20. However, since the displacement restricting portion 16 is deformed resiliently in the direction to displace the engaging end portion 16*a* of the displacement restricting portion 16 forward in the tool inserting direction, as described above, to allow the insertion allowing displacement of the lock 14, the connection of the female terminals T1 of the first connector C1 and the male terminals T2 of the second connector C2 caused by the insertion of the first housing 10 into the second housing 20 accompanied by the insertion allowing displacement can proceed. When this connection is completed, i.e. when the first housing 10 reaches the proper connection position shown in FIG. 3, electrical conduction between the terminals T1 and T2 is established.

In an incompletely connected state where the first housing 10 has not reached the proper connection position yet, the lock 14 is undergoing the insertion allowing displacement and the tool restraining portion 14*d* of the lock 14 restrains the restrained portions 36 of the connection detecting tool 30 from behind, as shown in FIG. 2. Thus, the connection detecting tool 30 cannot be pulled out in a rearward direction opposite to the tool inserting direction. That is, the connection detecting tool 30 continues to be restrained to block the departure of the connection detecting tool 30 from the operating position. This restraint disables the separation of the connection detecting tool 30 in the incompletely connected state. An operator can recognize that the connectors C1, C2 are not sufficiently connected yet when the connection detecting tool 30 cannot be separated.

On the other hand, when the first housing 10 reaches the proper connection position, the locked portion 14*c* of the lock 14 is released from pressing by the lock piece operating portion 26, as shown in FIG. 3, and the lock 14 resiliently returns to the lock position shown in FIG. 3. This causes the retreat of the locked portion 14*c* to be blocked by the lock piece operating portion 26 and the first housing 10 is locked in the second housing 20. On the other hand, for the resilient return of the lock 14, the tool restraining portion 14*d* is caused to resiliently return in a direction away from the housing body 12, thereby releasing the restraint of the restrained portions 36 of the connection detecting tool 30 by the tool restraining portion 14*d*. Thus, in this state, the operator can pull out the connection detecting tool 30 from the first housing 10 in the direction opposite to the tool inserting direction. As just described, the operator can recognize that the connection of the connectors C1, C2 has been completed when the connection detecting tool 30 can be separated from the first housing 10. Further, the thus separated connection detecting tool 30 can be repeatedly used in the connection detection of the same electrical connection device or another electrical connection device having an equivalent structure.

The invention is not limited to the above embodiment and can include, for example, the following embodiments.

The displacement restricting portion according to the invention may be connected to the housing body of the first housing. For example, a displacement restricting portion shaped similarly to the displacement restricting portion 16 according to the above embodiment may be connected to the housing body 12 to extend toward the lock 14 from the outer side surface of the housing body 12. Also in this case, the upper end part of the displacement restricting portion comes into contact with the underside of the lock 14 to block the insertion allowing displacement of the lock 14. Further, this upper end part is operated by the connection detecting tool to deflect and deform the tool restraining portion so that the displacement restricting portion can transition to a state where the displacement restricting portion is resiliently deformable to allow the insertion allowing displacement of the lock 14.

(2) In the present invention, a specific shape of the tool restraining portion provided on the lock can also be set appropriately. For example, a connection detecting tool may be formed with a restrained portion projecting toward the lock and the lock may be formed with a recess or through hole, into which the restrained portion is fit when the lock undergoes the insertion allowing displacement, i.e. when the lock is displaced toward the housing body, and the separation of the connection detecting tool may be blocked by the fitting of the restrained portion.

Specific shapes and uses of the first and second terminals do not matter. For example, the second terminal may be a joint terminal connected to the first terminals via a coupling for shorting to short the first terminals to each other.

As described above, an electrical connection device includes a first connector and a second connector that are connectable to each other and more reliably detects a connected state of the first and second connectors.

The invention claimed is:

1. An electrical connection device, comprising:

a first connector including a first terminal and a first housing for holding the first terminal;

a second connector including a second terminal to be electrically conductive to the first terminal by being connected to the first terminal and a second housing for holding the second terminal; and a connection detecting tool for detecting a connected state between the first and second terminals, wherein:

the second housing is shaped to receive the insertion of the first housing thereinto, and the first and second terminals are connected to each other according to the insertion of the first housing;

the first housing includes a housing body for holding the first terminal, a lock connected to the housing body, the lock being capable of undergoing an insertion allowing displacement to resiliently displace toward the housing body to allow the insertion of the first housing from an insertion blocking position where the insertion of the first housing into the second housing is blocked by the interference of the lock with the second housing, the lock being configured to lock the first housing in the second housing by resiliently returning in a direction opposite to a direction of the insertion allowing displacement to be locked to the second housing with the first housing inserted in the second housing to a proper connection position where the connection of the first and second terminals is completed, and a displacement restricting portion connected to the housing body or the lock, the displacement restricting portion being configured to block the insertion allowing displacement of the lock from the insertion blocking position by being interposed between the housing body and the lock;

the housing body includes a tool holding groove for holding the connection detecting tool at an operating position, and the connection detecting tool operates the displacement restricting portion at the operating position such that the displacement restricting portion is resiliently deformable to allow the insertion allowing displacement of the lock; and the lock includes a tool restraining portion, and the tool restraining portion restrains the connection detecting tool to block the departure of the connection detecting tool from the operating position in a direction opposite to a tool insertion direction in a state where the lock is undergoing the insertion allowing displacement, whereas the tool restraining portion releases the connection detecting tool to allow the departure of the connection detecting tool from the operating position as the lock portion resiliently returns to a lock position.

2. The electrical connection device of claim 1, wherein the tool holding portion allows the connection detecting tool to be inserted in a tool inserting direction parallel to an inserting direction of the first housing into the second housing along an outer side surface of the housing body, the displacement restricting portion is shaped to extend from the lock portion toward the housing body at the displacement blocking position and includes an engaging end portion configured to restrict a resilient displacement of the lock toward the housing body by being engaged with the housing body, the connection detecting tool operates to displace the engaging end portion in the tool inserting direction and disengage the engaging end portion and the housing body by being inserted to the operating position into the tool holding portion along the tool inserting direction, whereby the displacement restricting portion is set in a state resiliently deformable to allow the insertion allowing displacement of the lock.

3. The electrical connection device of claim 2, wherein the displacement restricting portion is shaped to be resiliently bendable and deformable in the tool inserting direction to enable the engaging end portion to be deflected and deformed in the tool inserting direction.

4. The electrical connection device of claim 3, wherein the connection detecting tool includes a restrained portion projecting more toward the lock than other parts on a front end in the tool inserting direction, and the tool restraining portion of the lock restrains the restrained portion to block a rearward movement of the restrained portion in the tool inserting direction by projecting toward the housing body.

5. The electrical connection device of claim 2, wherein the connection detecting tool includes a restrained portion projecting more toward the lock than other parts on a front end in the tool inserting direction, and the tool restraining portion of the lock restrains the restrained portion to block a rearward movement of the restrained portion in the tool inserting direction by projecting toward the housing body.

* * * * *